United States Patent [19]

Kruchen et al.

[11] Patent Number: 4,903,357

[45] Date of Patent: Feb. 27, 1990

[54] PILLOW OR TICKING PROVIDED WITH AN UNREMOVABLE INFORMATION MEDIUM

[75] Inventors: Hans Kruchen; Ernst Kruchen, both of Telgte, Fed. Rep. of Germany

[73] Assignee: Kruchen Gmbh, Telgte, Fed. Rep. of Germany

[21] Appl. No.: 336,689

[22] Filed: Apr. 12, 1989

[30] Foreign Application Priority Data

Jun. 29, 1988 [DE] Fed. Rep. of Germany ... 8808316[U]

[51] Int. Cl.[4] ..... A47G 9/00

[52] U.S. Cl. ..... 5/434; 5/448; 5/490; 40/299

[58] Field of Search ..... 5/434, 436, 490, 485, 5/442, 448, 472, 468; 40/299, 309; D6/601

[56] References Cited

U.S. PATENT DOCUMENTS

| | | | |
|---|---|---|---|
| 877,692 | 1/1908 | Wyman | 5/468 |
| 2,845,637 | 8/1958 | Di Stefano | 5/490 |
| 2,859,547 | 11/1958 | Davidson et al. | 40/309 |
| 4,080,675 | 3/1978 | Kanowsky et al. | 5/472 |
| 4,745,696 | 5/1988 | Scouten | 40/309 |

FOREIGN PATENT DOCUMENTS

| | | | |
|---|---|---|---|
| 1023202 | 1/1958 | Fed. Rep. of Germany | 5/485 |
| 2951089 | 2/1981 | Fed. Rep. of Germany | 5/490 |
| 2698 | of 1903 | United Kingdom | 5/490 |
| 118749 | 9/1918 | United Kingdom | 5/490 |

*Primary Examiner*—Alexander Grosz

*Attorney, Agent, or Firm*—Felfe & Lynch

[57] ABSTRACT

A pillow or the like having a tick filled with filling and having a corner with a button fixed thereto. The button has a shank which is riveted to a backing plate. The button bears information about the pillow.

5 Claims, 1 Drawing Sheet

PILLOW OR TICKING PROVIDED WITH AN UNREMOVABLE INFORMATION MEDIUM

BACKGROUND OF THE INVENTION

The invention relates to a rectangular pillow filled with down, feathers or other filling, or a fillable ticking.

It is known to provide pillows or ticking or the like with sew-on labels which can contain not only the trademark but also information on the manufacturer, the quality, and he like. It has been found disadvantageous, however, that these sew-ons can easily come off, and that then, for example, the manufacturer's name can no longer be learned in the event of complaints or repurchase. The same applies to quality ratings, so that low-quality goods can be sold as high-quality.

It is therefore the purpose of the invention to create a pillow or a fillable ticking, in which the information medium is fastened such that it cannot easily come off, and in which the removal of the information medium is clearly detectable. The information medium is furthermore not to interfere with the use of the pillow, must be easy and simple to attach, and the needed information must permit coding that is invisible except by scanning.

This purpose is accomplished in accordance with the invention by the fact that in one corner a plate configured as an information medium is permanently fastened to the ticking.

The fastening is to be such that, if it is removed, unremovable damage or marks will remain.

In detail this purpose is accomplished by the fact that the plate is a button which is riveted by means of a shank with a backing plate.

To make the information medium especially recognizable, the corner can be left unfilled and separated by a seam that is impassable to the filling. To reinforce the tightness and facilitate finding the information medium the seam can be a double seam.

In addition, a sew-on label bearing additional information can be disposed beside the seam.

BRIEF DESCRIPTION OF THE DRAWINGS

FIG. 2 is a cross-section of the tick and the button.

DETAILED DESCRIPTION OF THE PREFERRED EMBODIMENT

Figure 1:
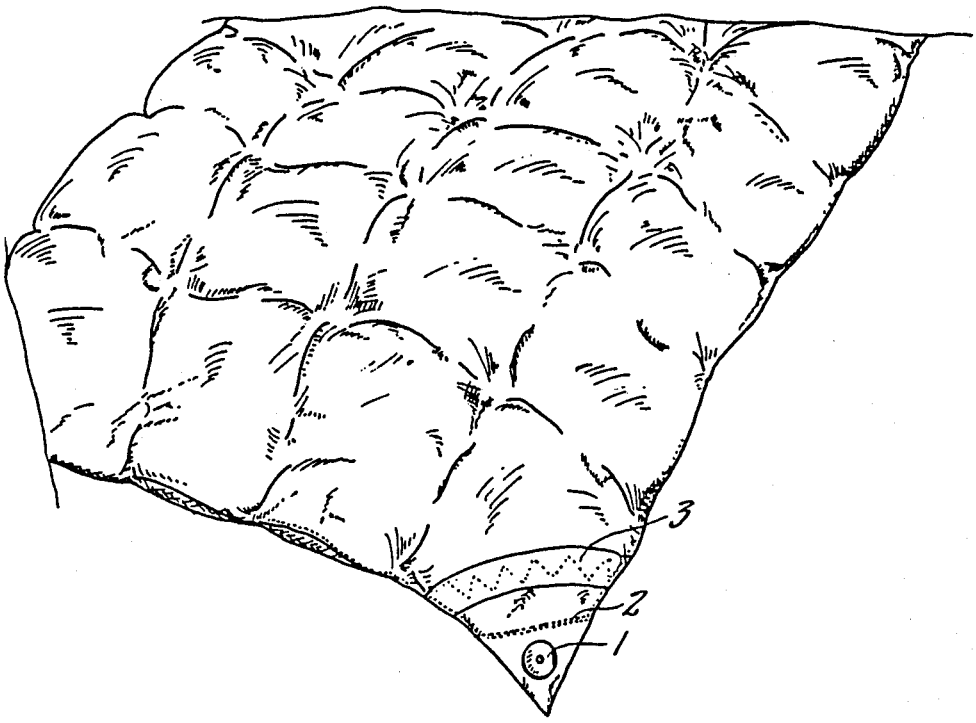
FIG. 1 is a perspective of a pillow having an information button.
Figure 1A:
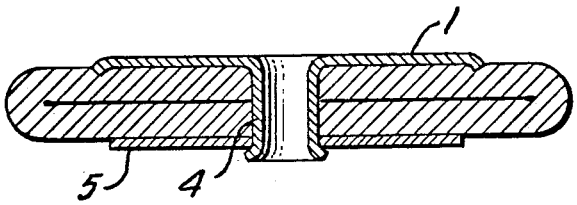

The ticking has at its corners, which are separated by a double seam through which the filling, including down, cannot pass, a button 1. The double seam is marked 2.

The button bears, visible or invisible, the desired information regarding the manufacturer, the quality, the date of manufacture, and the like, and is riveted with a shank 4 to a backing plate 5 so that removal is not possible without damaging the tick or can be detected by the presence of the opening for the shank.

A sew-on label 3 is disposed parallel to the double seam 2 and can give additional information, such as the trademark name and the like.

It is evident that the small information medium (shown oversize in the drawing) does not interfere with the use of the filled pillow, and since the button can be attached easily and economically, the invention can be considered as an ideal solution of the problems involved.

We claim:

1. A pillow or the like comprising a tick filled with filling and having a corner with a button fixed thereto, said button having a shank which is riveted to a backing plate, said button bearing information about the pillow.

2. Pillow as in claim 1 wherein the corner is unfilled and is separated by a seam (2) sealing off the filling.

3. Pillow as in claim 2 wherein the seam (2) is a single seam.

4. Pillow as in claim 2 wherein a sew-on label is disposed in addition to the seam (2).

5. Pillow as in claim 1 wherein a loop label stating content is sewed onto the tick.

* * * * *